United States Patent [19]

Hickman et al.

[11] 4,191,301

[45] Mar. 4, 1980

[54] ROTATION LIMITER

[75] Inventors: Charles E. Hickman, Tulsa; William C. Denwalt, Jr., Broken Arrow, both of Okla.

[73] Assignee: Auto Crane Company, Tulsa, Okla.

[21] Appl. No.: 916,571

[22] Filed: Jun. 19, 1978

[51] Int. Cl.[2] ..... B66C 23/84

[52] U.S. Cl. ..... 212/69; 182/19; 192/139; 188/69; 74/84 R

[58] Field of Search ..... 212/66–70, 212/28, 39 R, 39 B; 182/2, 19; 414/687, 694, 695; 188/31, 60, 69, 82.2; 192/138, 139; 74/84, 435, 436

[56] References Cited

U.S. PATENT DOCUMENTS

| | | | |
|---|---|---|---|
| 2,398,963 | 4/1946 | Reutlinger | 74/84 X |
| 2,599,677 | 6/1952 | Waguespack | 212/66 X |
| 2,746,573 | 5/1956 | Hastings | 188/69 X |

*Primary Examiner*—Albert J. Makay
*Attorney, Agent, or Firm*—Head & Johnson

[57] ABSTRACT

A device for limiting the rotation of a member rotatable about an axis extending from a base, while permitting rotation clockwise and counterclockwise through a preselected number of turns. An actuating lug is rigidly secured to the member, a disc is rotatably secured to the base, the disc having a plurality of bosses rigidly secured adjacent the periphery thereof, the bosses being spaced apart from each other in equal angular relationship, the bosses being engaged by the actuating lug to cause angular displacement of the disc upon each rotation of the member. A stop lug is rigidly secured to the base in the path of the disc bosses to engage therewith and arrest angular displacement of the disc and thereby the rotation of the member.

3 Claims, 9 Drawing Figures

ROTATION LIMITER

BACKGROUND OF THE INVENTION

This invention relates to means for limiting rotation of a member about its axis, and particularly the invention is concerned with a device for limiting the maximum number of rotational turns a crane boom is permitted to make about its vertical axis.

Many types of cranes, and similar devices, are required to rotate through more than 360°. This requirement introduces problems in that wrenches carried by the cranes must be supplied by a source of motive force, such as by electrical conductors or hydraulic lines. If rotatable cranes are permitted to be rotated without limitation, such conductors or lines can eventually be twisted until they are damaged or destroyed. If a crane is limited to not more than 360° of rotation, it is easy to limit the maximum angular rotation. However, it is frequently desirable to be able to rotate a crane more than 360°, and in fact, to be able to rotate it for several turns in either direction. At the same time, the maximum number of turns must be limited as above indicated to prevent damage or destruction to conductors or lines.

While the rotation limiter apparatus is particularly adaptable for use on cranes and will be described as applied to this environment for purposes of exemplification, the invention is not in any sense limited to use with cranes, but may be employed where an inexpensive device is needed to limit rotation of one object about an axis relative to another.

SUMMARY AND OBJECTS OF THE INVENTION

The invention is described in relation to a crane having an upright fixed pedestal. The crane includes a boom base rotatable about a vertical axis on the pedestal. Mounted on the boom base is a boom having, at its distal end, a lifting mechanism, such as a hook, which is connected by a cable to a winch situated adjacent the pedestal. The boom base has a projecting actuating lug rigidly secured thereto. A disc is rotatably secured to the pedestal adjacent the boom base, the disc having a plurality of bosses secured thereto adjacent the periphery, the bosses being spaced apart from each other in predetermined angular relationship. The bosses are engaged by the actuating lug to cause angular displacement of the disc upon each rotation of the boom base. A stop lug is rigidly secured to the pedestal in the path of the disc bosses to engage with selected bosses, thereby arresting further angular displacement of the disc and thereby of the boom base.

Accordingly, it is an object of the invention to provide a rotation limiting device which will permit rotation of a member clockwise and counterclockwise through a preselected number of turns and arrest further rotation.

Another object of the invention is to provide an inexpensive rotation limiting device that mounts on existing apparatus and requires minimal structural modification.

These, together with other objects, will become more fully apparent upon reference to the following description and the accompanying drawings as described hereinbelow.

DETAILED DESCRIPTION OF THE DRAWINGS

Figure 1:
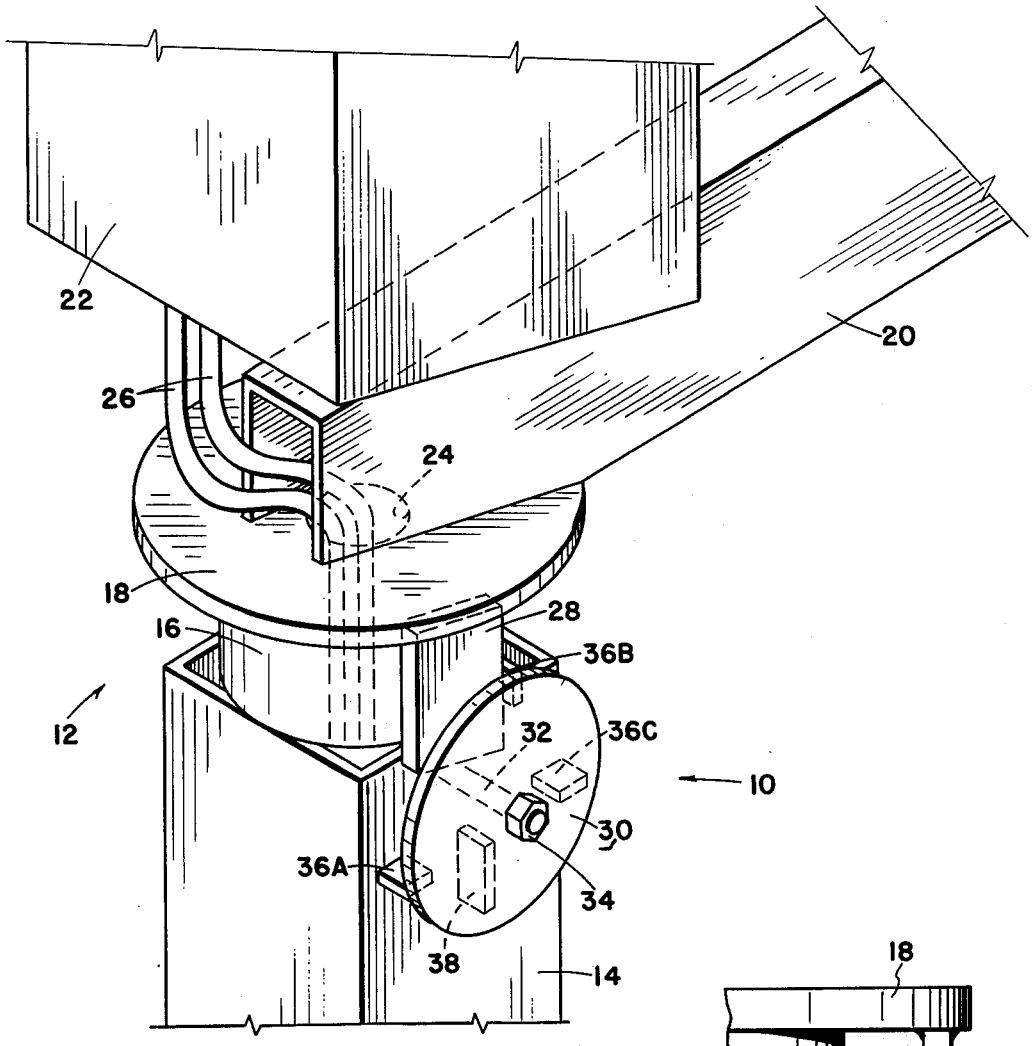
FIG. 1 is a rudimentary, isometric crane having a rotation limiting device embodying the principles of the present invention mounted thereon.

Referring to FIG. 1 of the drawings, a rotation limiting device embodying the principles of the present invention is generally indicated by the reference numerals 10. The limiting device is shown associated with a rudimentarily illustrated crane, generally denoted by number 12. As illustrated, the crane includes an upright stationary pedestal 14. A boom base 16 is rotatably mounted about a vertical axis at the upper end of pedestal 14, the base including a circular collar 18. A boom 20 is rigidly secured to collar 20 and includes an operating portion 22 usually containing a winch (not shown) operated either electrically or hydraulically. The pedestal 14, boom base 16, and collar 18 have an axial opening 24 therein which receives conductors or lines 26 which carry electricity to hydraulic fluid. It can be seen that if the boom base 16, including the boom 20 and other equipment mounted to it, is permitted to rotate an unlimited number of turns, the conductors or lines 26 will ultimately be twisted until they are destroyed.

Figure 2:
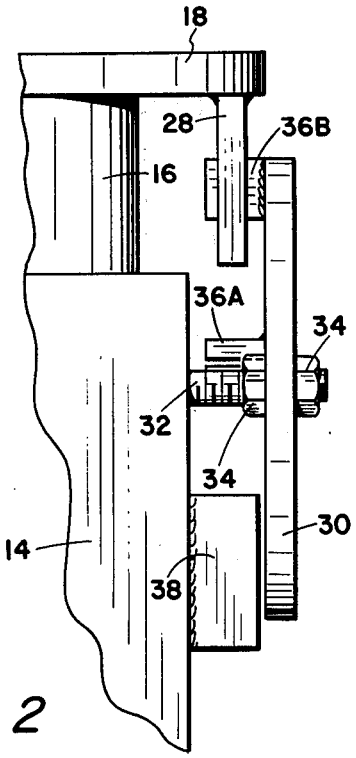
FIG. 2 is an enlarged view of the rotation limiting device of FIG. 1 and shows the cooperating parts.
Figure 3A:
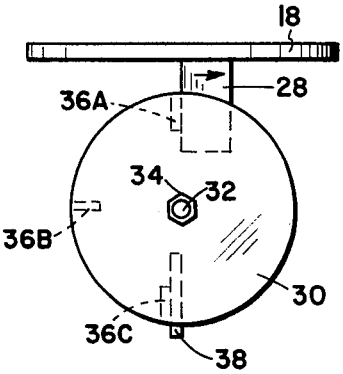
FIGS. 3A through 3G illustrate the operation of the present invention.
Figure 3B:
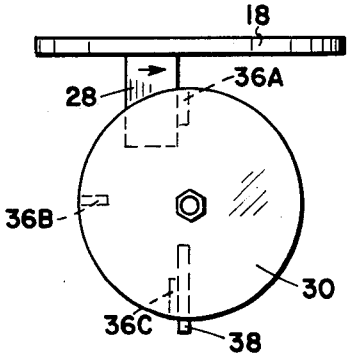
Figure 3C:
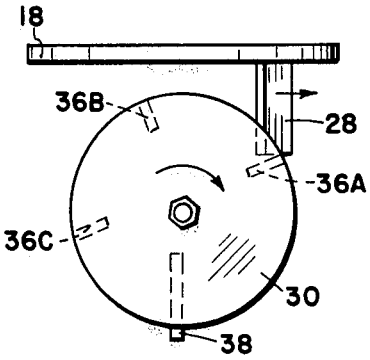
Figure 3D:
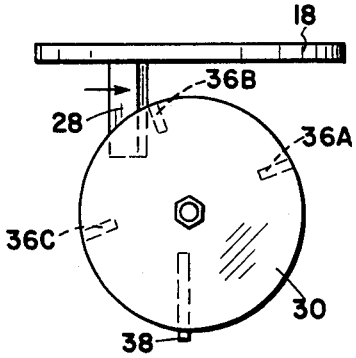
Figure 3E:
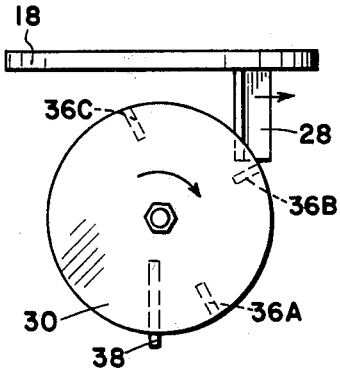
Figure 3F:
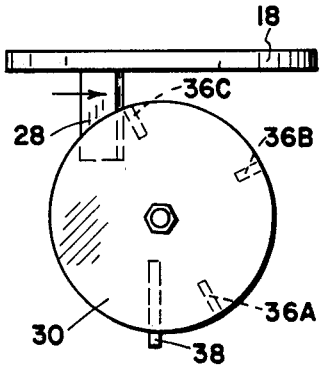
Figure 3G:
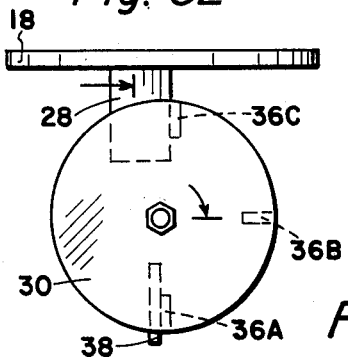

The rotation limiting device of the present invention comprises a downwardly directed actuating lug 28 attached to collar 18 adjacent the periphery thereof, such as by means of welding. A disc member 30 is rotatably supported about a horizontal axis to pedestal 14 near the upper end thereof, such as by means of a stud 32 and nuts 34. Disc 30 is provided with a plurality of bosses 36A, 36B, and 36C, welded or otherwise secured adjacent the disc periphery. See also FIG. 2. The bosses 36A, 36B, and 36C are spaced apart from each other in angular relationship dependent on the number of bosses used, as will be described in detail hereinbelow. The bosses are directed towards the pedestal 14 and situated to be engaged by the actuating lug 28 to cause angular displacement of disc 30. A stop lug 38 is rigidly secured to the pedestal 14 in the path of the disc bosses to engage one of the bosses and arrest angular displacement of the disc and thereby the rotation of the boom.

OPERATION

The operation of the rotation limiting device 10 is described in relation to a disc having three bosses 36A, 36B, and 36C as shown in FIG. 3. The first bosses are spaced 90° apart with a 180° gap. As illustrated in FIG. 3A, boss 36C is engaged by the stop lug 38, and boss 36A is engaged by actuating lug 28, preventing counterclockwise rotation of the disc 32 thereby arresting rotation to the left of collar 18. Thus, collar 18, and therefore the boom itself, can turn only in the direction to the right as indicated by the arrow. After the first turn of collar 18 through approximately 360°, actuating lug 28 engages first boss 36A as shown in FIG. 3B. Further rotation causes angular displacement of approximately 90° of the disc 30 as shown in FIG. 3C and as indicated by the arrow in that figure. This moves the boss 36B in position to be engaged by actuating lug 28 upon the next rotation of collar 18, as shown in FIG. 3D. This moves lug 36C into position as shown in FIG. 3E to be engaged by actuating lug 28 upon the next revolution, as shown in FIG. 3F. However, further rotation of collar 18 causes boss 36A to engage stop lug 38. Further clockwise angular displacement of the disc 30 is arrested, and thereby further rotation of collar 18, and the boom, to the right is terminated. It can be seen that from FIG. 3A to FIG. 3G, collar 18 has turned substantially three full revolutions. Further rotation of collar 18 to the right is terminated; however, the collar can rotate a full three complete revolutions to the left, reversing the sequence just described.

It will be apparent that the number of rotations clockwise or counterclockwise that the boom collar 18 and thereby boom 12 is to be limited to will determine the number of bosses on the disc 30.

When a larger number of bosses are employed to permit a greater number of revolutions of collar 18, the width and length of actuating lug 28 will be correspondingly adjusted so that upon each full revolution of collar 18, the next adjacent boss is rotated into position to be engaged by the actuating lug.

It will be apparent that the disc described herein serves as a rotation counter, and thus it is unnecessary to rely on operator's memory to keep an account of the number of turns that the boom may have made in the clockwise or counterclockwise direction.

The device is simple, inexpensive and convenient to install—factors that will be appreciated by those knowledgeable in the art.

As previously stated, the invention has been described as it is employed on a crane having a boom rotatable about a vertical axis solely for purposes of illustrating one application of the invention. The crane, including the pedestal and crane boom are illustrated very diagrammatically and are not intended to depict a particular appearance of a crane, but to exemplify any member rotatable about an axis relative to another member. The use of collar 18 is by example only, as many other means can be employed for attaching the actuating lug 28 to a rotatable member, such as crane base 16.

While the invention has been described in relation to the attached drawings, it should be understood that other and further modifications, apart from those shown or suggested herein may be made within the spirit and scope of this invention.

What is claimed is:

1. In an apparatus having a member rotatable about an axis extending from a base, a device for limiting rotation of the member, while permitting rotation clockwise and counterclockwise through a preselected number of turns, comprising:

(a) an actuating lug rigidly secured to either the rotatable member or the base;

(b) a disc rotatably secured to the other of the rotatable member or the base, the disc having a plurality of bosses secured thereto adjacent the periphery thereof, the bosses being spaced apart from each other, the bosses being engaged by the actuating lug to cause angular displacement of the disc upon each rotation of the rotatable member; and (c) a stop lug rigidly secured to the other member in the path of the disc bosses to engage therewith and arrest angular displacement of the disc and thereby the rotation of the rotatable member.

2. An apparatus according to claim 1 wherein said disc has three bosses, the first and second of which are 180° apart and the third equally spaced between the first and second, and wherein said stop lug is positioned between said first and second disc bosses, whereby said rotatable member may be rotated a maximum of three revolutions in either direction.

3. In a crane having a boom base with a boom extending therefrom, and a stationary pedestal, the boom base being rotatably secured on the pedestal, a device to limit the rotation of the boom base while permitting rotation clockwise and conterclockwise through a preselected number of turns, comprising:

(a) an actuating lug rigidly secured to the boom base;

(b) a disc rotatably secured to the pedestal and adjacent the boom base, the disc having a plurality of bosses secured to the disc adjacent the periphery thereof, the bosses being spaced apart from each other in angular relationship, the bosses being engaged by the actuating lug to cause angular displacement of the disc upon each rotation of the boom base; and (c) a stop lug secured to the pedestal in the path of the disc bosses to engage therewith and arrest angular displacement of the disc and thereby the rotation of the boom.

* * * * *